United States Patent [19]

Charles et al.

[11] Patent Number: 4,869,790

[45] Date of Patent: Sep. 26, 1989

[54] METAL SEPARATION PROCESS

[75] Inventors: James A. Charles, Cambridge; Piers M. Copham, Merseyside; Derek J. Fray, Cambridge, all of United Kingdom

[73] Assignee: The British Petroleum Company p.l.c., London, England

[21] Appl. No.: 206,340

[22] PCT Filed: Oct. 14, 1987

[86] PCT No.: PCT/GB87/00720

§ 371 Date: Jun. 13, 1987

§ 102(e) Date: Jun. 13, 1987

[87] PCT Pub. No.: WO88/02793

PCT Pub. Date: Apr. 21, 1988

[30] Foreign Application Priority Data

Oct. 14, 1986 [GB] United Kingdom ..... 8624561

[51] Int. Cl.[4] ..... C25C 3/00; C25C 7/00

[52] U.S. Cl. ..... 204/64 R; 204/66; 204/243 R; 204/247

[58] Field of Search ..... 204/64 R, 64 T, 65.71, 204/245, 247, 273, 243 R

[56] References Cited

U.S. PATENT DOCUMENTS

| | | | |
|---|---|---|---|
| 808,095 | 12/1905 | Lang | 204/273 |
| 3,450,524 | 6/1969 | Pascaud et al. | 204/64 R |
| 3,691,048 | 9/1972 | Yznaga | 204/245 |
| 3,909,375 | 9/1975 | Holiday et al. | 204/64 |

OTHER PUBLICATIONS

Bureau of Mines Report of Investigations, 6454, 1964, by F. X. McCawley et al., pp. 1–4.

*Primary Examiner*—John F. Niebling
*Assistant Examiner*—David G. Ryser
*Attorney, Agent, or Firm*—George W. Moxon, II; Joseph G. Curatolo; Larry W. Evans

[57] ABSTRACT

An electrolytic cell for the electrolysis of molten salt having rotatable anode and cathode electrodes in a container for the molten electrolyte. The electrodes are conical in shape and have vent holes facilitating removal of evolved gases from the electrode surfaces. The liberated metal is thrown from the electrode and collected. The electrodes may be arranged in a symmetrical stack.

13 Claims, 3 Drawing Sheets

Key: INSULATION
ANODE
CATHODE

METAL SEPARATION PROCESS

BACKGROUND OF THE INVENTION

The present invention relates to the separation of metals from metal salts and more particularly relates to the separation of metals from fused salts by electrochemical or electrowinning processes.

It is known to separate certain metals from their salts by electrolysis of the molten electrolyte for example, the individual separation of aluminum may be achieved by the electrolysis of a molten solution of alumina in cryolite (the so-called Hall-Heroult process). An alternative process for the production of aluminium involves the electrolysis of molten aluminium chloride using a bipolar cell. Also magnesium may be produced by the electrolysis of molten magnesium chloride in a bipolar cell as disclosed in European patent numbers 0096990 and 0101243.

Requirements for the efficient production of metals by electrolysis of their molten salts include a cell having a low tendency for the products of the electrolysis to recombine and a low electrical internal resistance. The tendency for recombination may be overcome by the interposition of a diaphragm to separate the anode and cathode. However, the presence of the diaphram tends to internal resistance of the cell.

SUMMARY OF THE INVENTION

Thus, it is desirable to have a diaphragmless cell having high current efficiency by use of reduced anode-cathode gaps giving reduced internal resistance but without significant recombination of the products of the electrolysis. The present invention relates to an improved process for the separation of metals by electrolysis of a molten salt which uses rotating or movable electrodes to reduce the tendency for product recombination.

Thus according to the present invention there is provided an electrolytic cell for the electrolysis of molten salts comprising a container for a molten electrolyte, an anode electrode and a cathode electrode, one or both being adapted for rotation and being located within the container, the electrodes having means facilitating the removal of evolved gases from the surfaces of the electrodes and means for collecting metal liberated at the electrode.

The rotatable anode or cathode are suitably conical in shape, the apex of the cone oriented upwardly towards the top of the cell. The conical shape of the cell tends to enhance removal of the products of electrolysis by the effect of gravity and the effect of centrifugal forces. The cell is preferably a bipolar cell and most preferably has a plurality of conical shaped electrodes, the electrodes being arranged in a symmetrical stack. The angle of divergence of the come from the horizontal is preferably from 30° to 50°.

BRIEF DESCRIPTION OF THE DRAWINGS

The means facilitating removal of evolved gases from the surfaces of the electrodes preferably comprises one or more vent holes preferably passing through the upper most electrode of the cell. The rotational speed of the electrodes is dependent on the flow conditions but is usually chosen to give a minimal degree of turbulence, turbulence tending to cause the undesirable recombination of the products of electrolysis.

Also according to a further aspect of the invention there is provided a process for producing metal from molten metal salts comprising the steps of (a) electrolysing the molten metal salt in a container having one or more anode and cathode electrodes, (b) the electrodes being adapted for relative rotation and having means facilitating the removal of evolved gases, and (c) collecting the metal liberated from the electrode. The process may be a batch process or a continuous process. The electrodes of the cell may be treated e.g. by coating with a suitable material, to enhance the flow of the metal produced off the surface of the electrodes. The electrodes are preferably fabricated from graphite and is preferably very hard so as to resist impact or mechanical damage. It is also envisaged that conducting borides such as titanium boride could be used as the cathode and inert conducting oxides as the anode. It is envisaged that the cell and process may be used for various metal/metal salt electrolyses the metals being liquid at the temperature of the electrolysis such as for zinc, magnesium and aluminum and lithium.

The electrolysis of molten salts to produce a metal is quite different from the electrolysis of aqueous metal solution. Thus in aqueous solution the metal is generally obtained as an electrodeposit on one of the electrodes the metal being subsequently recovered by scraping. At the temperature of molten salt electrolysis, the metal is generally formed as a liquid at the electrode surface and the problems are usually to avoid recombination of the metal and to collect the metal. The present invention is intended to eliminate or reduce these problems.

The invention will now be described by way of example only and with reference to FIGS. 1 and 2 of the accompanying drawings.

Figure 1:
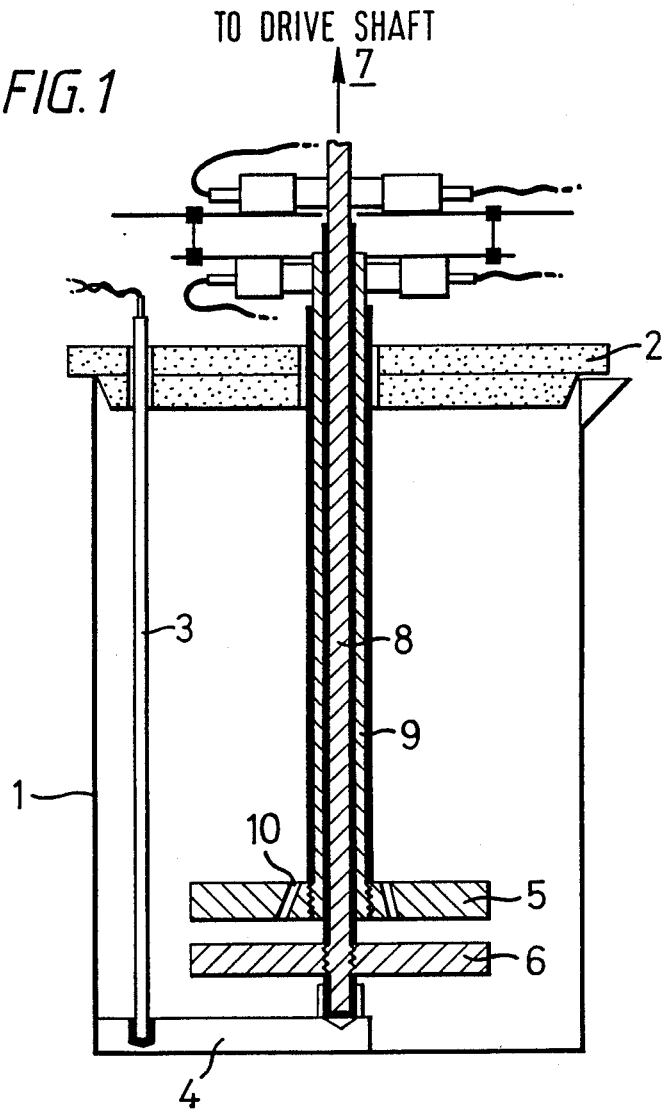

FIG. 1 is a schematic vertical section of a monopolar electrolytic cell for metal separation.

The present example relates to an electrolytic cell for the production of zinc from a fused salt bath of zinc chloride, potassium chloride and sodium chloride. The cell comprises a insulating refractory silica shell 1 having an insulating lid 2. The cell has a chromel/alumel thermocouple 3 passing through the lid 2 and locating with a pivot plate 4 at the base of the cell.

The electrodes comprise a pair of parallel horizontal graphite discs 5, 6 spaced apart from each other by a small gap. The electrodes 5, 6 are connected to a drive shaft 7 by a central copper rod 8 and a surrounding coaxial copper tube 9, the central copper rod being connected to the lower (cathode) electrode 6 and the copper tube being connected to the upper (anode) electrode 5. The central copper rod 8 extends beyond the lower electrode so as to locate with the pivot plate 4. The copper rod and tube are insulated from each other by a ceramic tube.

The anode and cathode are electrically insulated from each other by use of insulating spacers in the rod/-tube arrangement. The anode has one or more holes or vents 10 passing therethrough so as to encourage the escape of electrolysis gases. The electrodes were rotated using a small AC electric motor (not shown) connected through a simple variable gear to the drive shaft 7.

The electrolytic cell was surrounded by a furnace (not shown) comprising a "Kanthal" heating coil wound around a suitably insulated cylinder and having a metal casing. The furnace heating was controlled with a SKIL 59 temperature controller.

During use of the electrolytic cell, the electrolyte used was a mixture of a small quantity of ammonium chloride and zinc chloride, potassium chloride and sodium chloride (Analar grade). The electrolyte was heated to produce a metal (about 763° K.) and was allowed time to stabilise. An electric current was then passed between the cathode and anode to initiate the electrolysis.

The rotation of the electrodes during the electrolysis produces a centrifugal force tends to accelerate the removal of the products of electrolysis from the electrode surfaces. Thus, in FIG. 1, the simple parallel disc electrode assembly tends to throw the denser metal product outwards while the evolved gas moves inward and bubbles through the central vent.

Figure 2:
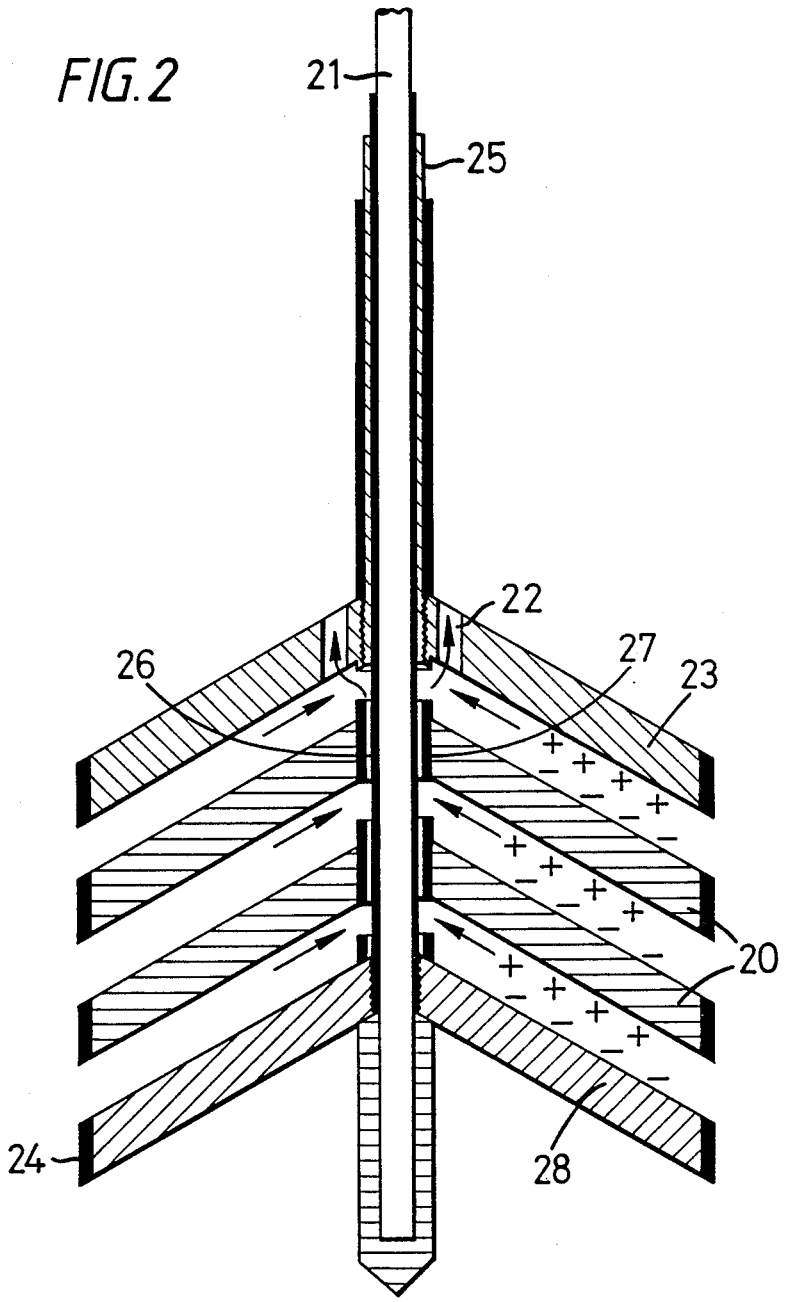

FIG. 2 shows a schematic vertical section of an alternative rotating electrode arrangement having a bipolar electrode assembly using four conical graphite electrodes supported centrally and spaced apart from each other. The two central electrodes 20 are not directly electrically connected and the central cathode contact 21 is insulated from the conical graphite electrodes 20. The upper anode electrode 23 has outlet holes 22 for passage of gases evolved during the electrolysis. Gases evolving from the lower anodic surfaces pass upwards between insulating ceramic tube 26 and the ceramic spacer 27 and eventually pass through the outlet holes or vents 22.

The central rod 21 is the cathode contact and the tube 25 is the anode contact. The uppermost conical plate is the anode electrode 23, the central plates then being polarised so that the surfaces are alternatively cathodic and anodic down the stack with the cathode electrode 24 at the lower end. The ends 24 of each of the graphite electrodes are electrically insulated.

TABLE

| Electrode Type | Electrode Dimension | Cone Angle (°) | Rotation of Speed (r.p.m.) | Voltage Current Density | Current Efficiency (%) |
|---|---|---|---|---|---|
| Plane disc monopolar | Diameter = 100 mm<br>Thickness of plate = 10 mm<br>Gap = 4 mm<br>Surface area = $7.8 \times 10^{-2}$ sq.mm. | — | 64 | 3.5 V.<br>78 A.<br>10000 A/sq.m. | 75.5 |
| Conical monopolar | Diameter = 100 mm<br>Thickness of plate = 10 mm<br>Gap = 4 mm<br>Surface area = $10.1 \times 10^{-2}$ sq.mm. | 40° | 44 | 5.8 V.<br>101 A.<br>10000 A/sq.m. | 85.7 |
| Conical bipolar | Diameter = 100 mm<br>Thickness of plate = 10 mm<br>Gap = 4 mm<br>Surface area = $9.96 \times 10^{-2}$ sq.mm. | 40° | 44 | 11.7 V.<br>75 A.<br>7500 A/sq.m. | 51.2 |
| Conical monopolar | Diameter = 200 mm<br>Thickness of plate = 20 mm<br>Gap = 4 mm<br>Surface area = $3.75 \times 10^{-2}$ sq.mm. | 35° | 44 | 3.8 V.<br>190 A.<br>5080 A/sq.m. | 81.7 |

Figure 3:
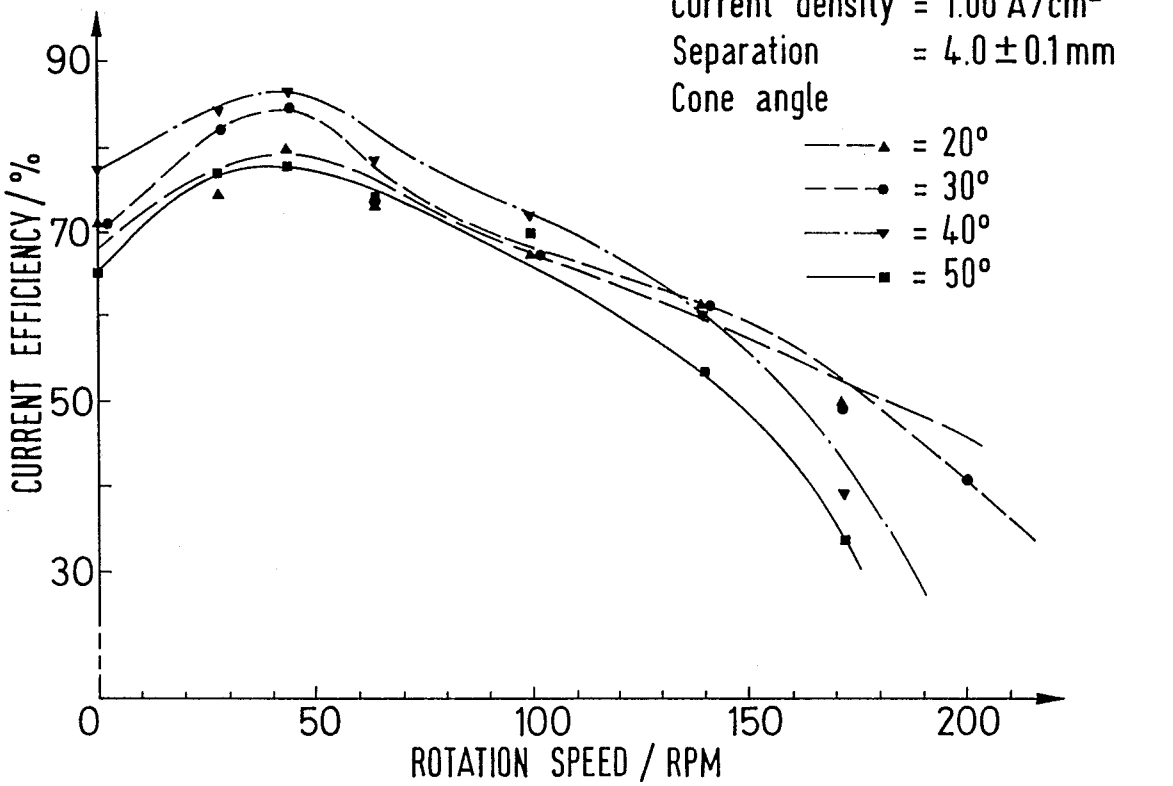

The results shown in the table and in FIG. 3 were obtained using an electrolyte comprisng 45% by weight of zinc chloride ($ZnCl_2$), 45% by weight of potassium chloride (KCl) and 10% by weight of sodium chloride (NaCl) at a temperature of about 500° C. The process was carried out in a silica crucible and used graphite electrodes having an interelectrode gap of 4 mms and at a current density of 5000 to 10000 amps per sq. meter. The table 1 shows results for both plane and conical shaped electrodes operating in both monopolar and bipolar modes. FIG. 3 shows variation of current efficiency and relative rotational electrode speed for the process and in particular shows optimum current efficiency at a cone angle of 40° from the horizontal for the conical electrode arrangement.

We claim:

1. An electrolytic cell for the electrolysis of molten salts comprising:

(a) a container for a molten electrolyte, (b) an anode electrode and a cathode electrode, one or both electrodes being adapted for centrifugal rotation and being located within the container, the electrodes being spaced apart and parallel to each other with a common axis of rotation and having means facilitating the removal of evolved gases from the surfaces of the electrodes, and (c) means for collecting metal liberated at the electrode.

2. An electrolytic cell according to claim 1 in which either the anode or cathode electrode is fixed and the other electrode is rotatable.

3. An electrolytic cell according to claim 1 comprising one or more pairs of planar parallel electrodes.

4. An electrolytic cell according to claim 1 in which the electrodes are generally conical in shape, the apex of the cone being oriented in an upwards direction.

5. An electrolytic cell according to claim 4 in which the angle of divergence of the cone from the vertical is from 30° to 50°.

6. An electrolytic cell according to claim 1 comprising a plurality of electrodes arranged in a symmetrical stack.

7. An electrolytic cell according to claim 1 in which the means facilitating removal of evolved gases from the surfaces of the electrodes comprising one or more vent holes.

8. An electrolytic cell according to claim 7 in which the vent holes pass through the uppermost electrode of the cell.

9. An electrolytic cell according to claim 1 in which the electrodes are fabricated from graphite.

10. An electrolytic cell according to claim 1 in which the cathode is a conducting metal boride and the anode is an inert conducting oxide.

11. A process for producing metal from molten metal salts comprising the steps of (a) electrolysing the molten metal salt in a container having one or more anode and cathode electrodes, one or both of the electrodes being adapted for relative rotation, being spaced apart and parallel to each other with a common axis of rotation, and having means facilitating the removal of evolved gases, (b) rotating at least one of the electrodes during the electrolysis to produce a centrifugal force, and (c) collecting the metal liberated from the electrode.

12. A process according to claim 11 which is carried out in a batch mode or a continuous mode.

13. A process according to claim 11 in which the electrodes are treated so as to enhance the flow of metal produced off the surface of the electrodes.

* * * * *